US011952703B2

(12) United States Patent
Kim et al.

(10) Patent No.: US 11,952,703 B2
(45) Date of Patent: Apr. 9, 2024

(54) WASHING MACHINE

(71) Applicant: LG Electronics Inc., Seoul (KR)

(72) Inventors: Jaehyun Kim, Seoul (KR); Kayeon Kim, Seoul (KR); Junghoon Lee, Seoul (KR); Myunghun Im, Seoul (KR); Kyungchul Woo, Seoul (KR); Seonhwa Yu, Seoul (KR); Hwanjin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 300 days.

(21) Appl. No.: 17/272,077

(22) PCT Filed: Aug. 21, 2019

(86) PCT No.: PCT/KR2019/010620
§ 371 (c)(1),
(2) Date: Feb. 26, 2021

(87) PCT Pub. No.: WO2020/045887
PCT Pub. Date: Mar. 5, 2020

(65) Prior Publication Data

US 2021/0324562 A1 Oct. 21, 2021

(30) Foreign Application Priority Data

Aug. 30, 2018 (KR) ..... 10-2018-0103078
Jan. 7, 2019 (KR) ..... 10-2019-0001970

(51) Int. Cl.
*D06F 37/06* (2006.01)

(52) U.S. Cl.
CPC ..... *D06F 37/06* (2013.01); *D06F 37/065* (2013.01)

(58) Field of Classification Search
CPC ..... D06F 37/06; D06F 37/065
See application file for complete search history.

(56) References Cited

U.S. PATENT DOCUMENTS

2003/0000105 A1* 1/2003 Song ..... D06F 37/06 34/595
2009/0133447 A1* 5/2009 Yoon ..... D06F 37/04 68/23.1

(Continued)

FOREIGN PATENT DOCUMENTS

CN 105544148 B * 1/2018 ..... D06F 23/02
CN 108866917 A * 11/2018

(Continued)

OTHER PUBLICATIONS

Machine translation of CN-108866917-A. (Year: 2018).*

(Continued)

*Primary Examiner* — Joseph L. Perrin
(74) *Attorney, Agent, or Firm* — Fish & Richardson P.C.

(57) ABSTRACT

The present disclosure relates to a washing machine configured to rotate a cylindrical drum formed by processing a metal sheet about a horizontal axis. The drum includes a lifter, formed by processing the metal sheet, respectively provided at a plurality of points spaced along a circumferential direction, when viewed from a front side. The lifter includes a front lifter which is formed by protruding the metal sheet into the drum, and pressurized to be extended in a longitudinal direction of the drum, and a rear lifter disposed in a rear side of the front lifter. The rear lifter is disposed to form a certain phase angle with respect to the front lifter.

14 Claims, 12 Drawing Sheets

(56) References Cited

U.S. PATENT DOCUMENTS

| | | | | |
|---|---|---|---|---|
| 2011/0048080 | A1 | 3/2011 | Oertel et al. | |
| 2012/0304705 | A1* | 12/2012 | Jeong | D06F 37/02 68/142 |
| 2013/0081432 | A1 | 4/2013 | Choi et al. | |

FOREIGN PATENT DOCUMENTS

| | | | | |
|---|---|---|---|---|
| DE | 1827413 | | 3/1961 | |
| DE | 29717594 | | 11/1997 | |
| EP | 0533004 | | 3/1993 | |
| EP | 1382732 | | 1/2004 | |
| EP | 2280108 | | 2/2011 | |
| JP | S58173596 | | 10/1983 | |
| JP | H09215894 | | 8/1997 | |
| JP | 2009506797 | | 2/2009 | |
| JP | 2012055349 | | 3/2012 | |
| JP | 2017099723 | | 6/2017 | |
| KR | 20060121078 | A * | 11/2006 | D06F 37/04 |
| KR | 101041801 | | 6/2011 | |
| KR | 20120136801 | | 12/2012 | |
| KR | 20130123540 | | 11/2013 | |
| KR | 20140129781 | | 11/2014 | |
| RU | 2590130 | | 8/2013 | |
| WO | WO-2006126814 | A2 * | 11/2006 | D06F 37/02 |
| WO | WO2016023876 | | 2/2016 | |

OTHER PUBLICATIONS

Machine translation of CN-105544148-B. (Year: 2018).*

Machine translation of KR-20060121078-A. (Year: 2006).*

Office Action in Japanese Appln. No. 2021-510937, dated Apr. 19, 2022, 9 pages (with English translation).

Extended European Search Report in European Appln. No. 19854464.5, dated Oct. 12, 2022, 15 pages.

Office Action in Russian Appln. No. 2021108234/03, dated Sep. 9, 2021, 12 pages (with English translation).

International Search Report in International Appln. No. PCT/KR2019/010620, dated Dec. 20, 2019, 5 pages (with English translation).

Office Action in Indian Appln. No. 202117013615, dated Aug. 23, 2021, 6 pages.

Office Action in Australian Appln. No. 2019332488, dated Apr. 20, 2022, 6 pages.

Japanese Office Action in Japanese Application No. 2021-510937, dated Jan. 10, 2023, 8 pages (with English translation).

* cited by examiner

WASHING MACHINE

CROSS-REFERENCE TO RELATED APPLICATIONS

This application is a National Stage application under 35 U.S.C. § 371 of International Application No. PCT/KR2019/010620, filed on Aug. 21, 2019, which claims the benefit of Korean Patent Application No. 10-2018-0103078, filed on Aug. 30, 2018 and Korean Patent Application No. 10-2019-0001970, filed on Jan. 7, 2019. The disclosures of the prior applications are incorporated by reference in their entirety.

BACKGROUND OF THE INVENTION

1. Field of the Invention

The present disclosure relates to a washing machine, and more particularly, to a washing machine having a lifter formed at the drum.

2. Description of the Related Art

A washing machine configured to have a drum, into which laundry is loaded, that is rotated about a horizontal axis is widely known.

For example, in a washing machine disclosed in Korean Patent Publication No. 10-2011-0022359 (Prior Art 1), a lifter disposed in an inner circumferential surface of a drum lifts laundry when the drum rotates.

In such a washing machine provided with the lifter installed in the drum, laundry is lifted up to a certain height by the physical force exerted by the lifter and then falls, or a friction between the lifter and the laundry is induced.

Therefore, it is possible to secure a certain level of washing force, which is less affected by the amount of water filled in the drum, the amount of laundry (cloth amount), and the rotational speed (RPM) of the drum, in comparison with a structure having no lifter.

U.S. Pat. No. 8,893,532 (Prior Art 2) discloses a washing machine drum having a linear elevation formed on an inner circumferential surface.

The drum of the Prior Art 2 is formed by plastic working a metal sheet to form a protruding structure, and then rolling the metal sheet and joining both ends thereof to each other.

However, in the protruding structure, since the inner circumferential surface of the drum has a convex shape but the outer circumferential surface has a concave shape (i.e., a shape formed by partly bending a metal sheet), the drum having a structure in which a plurality of protruding structures are formed in the circumferential direction is vulnerable to crushing.

Specifically, when one end portion of the drum is rotated in connection with the motor, a shear stress may be concentrated in the center portion of the protruding structure, thereby generating plastic deformation which causes the drum to be permanently deformed.

When one end portion of the drum connected to the motor is accelerated or decelerated to rotate, a shear stress for twisting the drum in the rotation direction of the drum is generated in an intermediate portion between one end portion and the other end portion of the drum.

In particular, since the drum is formed of a thin metal sheet and the protruding structure forms an opening surface and includes a curved shape, the shear stress is concentrated in the intermediate portion of the protruding structure so that the drum is plastically deformed or severely destroyed.

SUMMARY OF THE INVENTION

The present disclosure has been made in view of the above problems, and provides a washing machine which has a drum formed by joining both ends of a metal sheet rolled as a cylindrical shape, and has a lifter, which is protruded into the drum, formed by plastic-working the metal sheet, and provides a washing machine that can reduce the plastic deformation of the drum by improving the structure of the lifter.

The present disclosure further provides a washing machine having excellent durability by increasing the fatigue life N of the drum so that even if a shear stress applied to the drum is less than yield strength, fatigue failure is not caused by long-time multiple rotations. Fatigue failure is a failure caused by prolonged stresses in a structure under dynamic fluctuating stresses.

Fatigue life is the total number of stress cycles required to cause fatigue failure in a specific stress.

The present disclosure relates to a washing machine configured to rotate a cylindrical drum formed by processing a metal sheet about a horizontal axis.

The drum includes a lifter, formed by processing the metal sheet, respectively provided at a plurality of points spaced along a circumferential direction, when viewed from a front side.

The lifter includes a front lifter which is formed by protruding the metal sheet into the drum, and pressurized to be extended in a longitudinal direction of the drum, and a rear lifter disposed in a rear side of the front lifter.

The rear lifter is disposed to form a certain phase angle with respect to the front lifter.

The lifter is formed at each of three or four points disposed at equal intervals with respect to a center of the drum.

The front lifter and the rear lifter are not overlapped with each other when viewed in a rotation axis direction, and a rear end of the front lifter is disposed in a front side of a front end of the rear lifter.

The front lifter and the rear lifter overlap each other, when viewed in a direction of rotation axis, and a rear end of the front lifter is disposed in a front side of a front end of the rear lifter.

The front lifter and the rear lifter overlap each other, when viewed in the circumferential direction.

The rear lifter is positioned ahead of the front lifter in the circumferential direction of the drum by a phase angle.

At least one of the front lifter and the rear lifter is protruded into the drum by 10 to 30 mm.

The metal sheet is formed of stainless steel and has a thickness of 0.4 to 0.6 mm.

The drum has a reinforcement groove, which is extended in the circumferential direction, formed in an area corresponding to a distance between the rear end of the front lifter and the front end of the rear lifter.

The reinforcement groove is extended to connect a point corresponding to an outer edge of the front lifter and a point corresponding to an outer edge of the rear lifter.

A plurality of reinforcement grooves are disposed spaced apart along the longitudinal direction of the drum.

The reinforcement groove is formed on an inner circumferential surface so that an outer circumferential surface of the drum is formed convexly.

A reinforcement groove is extended in the circumferential direction, and formed in an area corresponding to a distance between the rear end of the front lifter and the front end of the rear lifter, and the reinforcement groove is extended to connect a point corresponding to an outer edge of the front lifter and a point corresponding to an outer edge of the rear lifter.

A reinforcement groove is formed in an area corresponding to: between a rear end of the front lifter and a front end of the rear lifter; and between an inner edge of the front lifter and an inner edge of the rear lifter.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1:
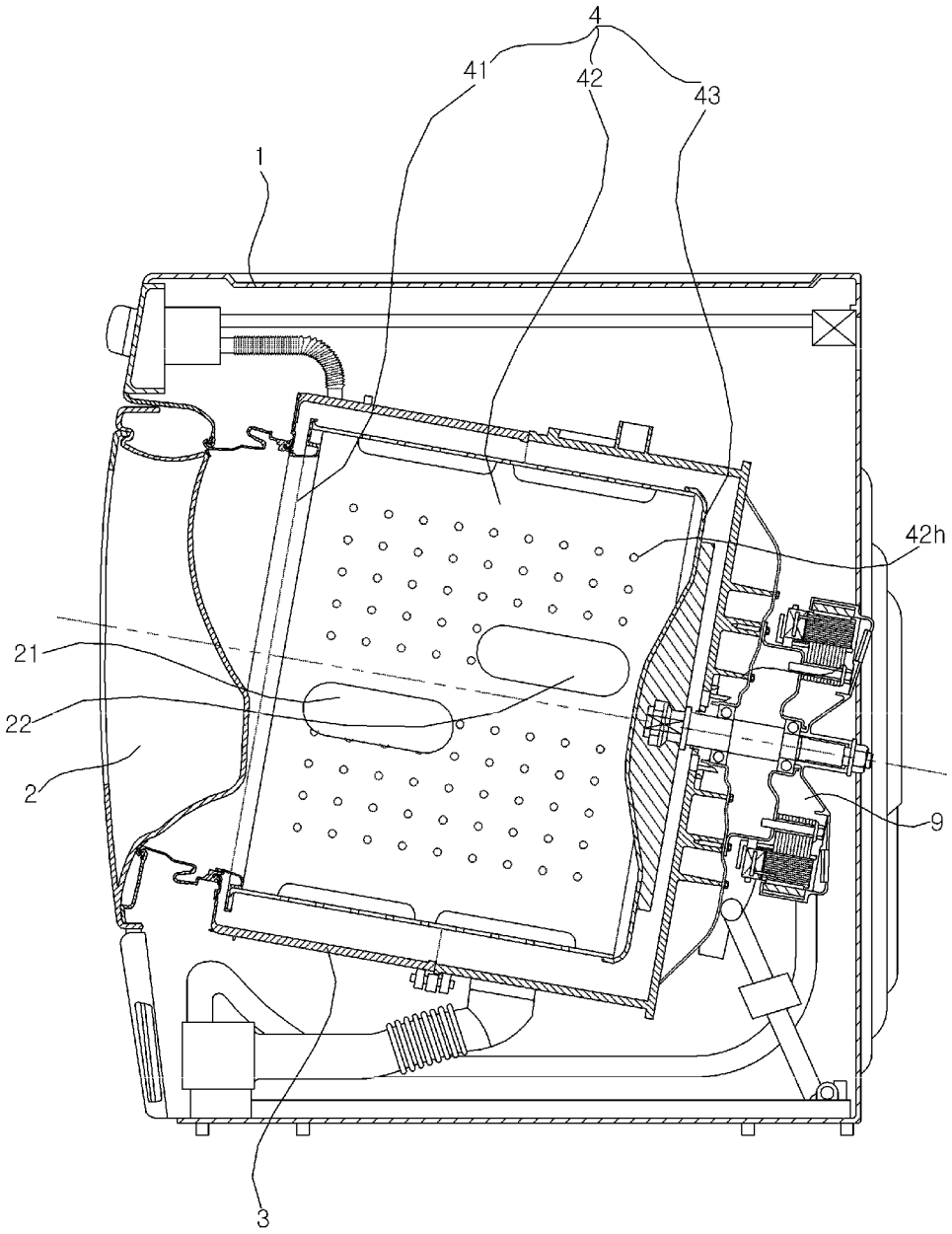
FIG. 1 is a side cross-sectional view of a washing machine according to an embodiment of the present disclosure.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is defined only by the scope of the claims. Like reference numerals refer to like elements throughout the specification.

First, the overall structure of a washing machine according to an embodiment of the present disclosure will be described with reference to FIG. 1.

The washing machine according to an embodiment of the present disclosure includes a casing 1 which forms an external shape and has a laundry loading port formed in a front surface thereof, and a door 2, which opens and closes the laundry loading port, that is rotatably provided in the casing 1.

In addition, the washing machine according to an embodiment of the present disclosure includes a water storage tank 3 which is disposed inside the casing 1 and stores washing water, a washing tub 4 which is rotatably installed in the water storage tank 3, and into which the laundry is loaded, and a motor 9 which rotates the washing tub 4.

The washing tub 4 includes a front cover 41 having an opening for entering and exiting laundry, a cylindrical drum 42 disposed substantially horizontally so that a front end is coupled to the front cover 41, and a rear cover 43 coupled to a rear end of the drum 42.

The rotating shaft of the motor 9 may be connected to the rear cover 43 by passing through the rear wall of the water storage tank 3. A through hole **42*h* may be formed in the drum 42 so that water may exchange between the washing tub 4 and the water storage tank 3**.

The washing tub 4 is rotated about a horizontal axis. Here, "horizontal" does not mean a geometric horizontal in a strict sense, and even when the washing tub 4 is inclined at a certain angle with respect to the horizontal as shown in FIG. 1, it is closer to horizontal than vertical. Thus, it can be said that it is rotated about a horizontal axis.

Figure 2:
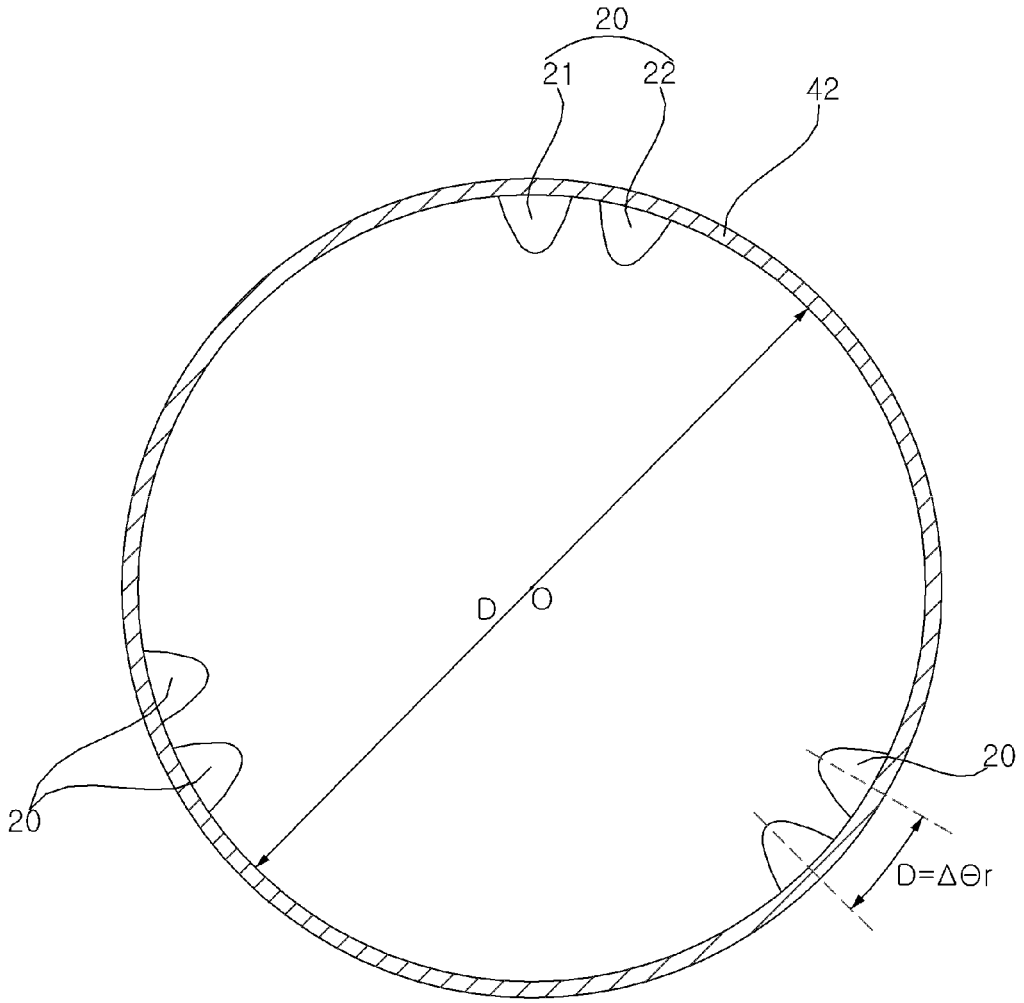
FIG. 2 schematically illustrates a cross section of a washing tub shown in FIG. 1.

Next, the structure of the lifter 20 of the washing machine according to an embodiment of the present disclosure will be described with reference to FIG. 2.

The drum 42 has a lifter 20 formed, by processing the metal sheet material, at a plurality of points spaced apart in the circumferential direction when viewed from the front.

A plurality of lifters 20 are extended in the front-rear direction on the inner circumferential surface of the drum 42, and are preferably disposed at a constant angle (equal angles) with respect to the center O of the drum 42.

For example, the lifter 20 may be disposed at three points obtained by dividing the center O of the drum 42 by three or four points obtained by dividing the center O of the drum 42 by four.

However, the disposition structure of the lifter is not limited to the structure disclosed in the above description and drawings, but will be included to the extent that a person skilled in the art can easily change design.

Each lifter 20 includes a front lifter 21 and a rear lifter 22 that are formed by protruding a metal sheet 10 mm or more into the drum 42 (e.g., about 10 to 30 mm) and pressing the metal sheet to be extended along the longitudinal direction of the drum 42.

The rear lifter 22 may be spaced apart from the front lifter 21 and disposed in the rear of the front lifter 21.

In the present specification, the expression "disposed in the 'rear'" means that it is disposed farther from the door 2 than the front lifter 21 formed in the drum 42 or disposed closer to the motor 9.

Furthermore, the rear lifter 22 according to the embodiment of the present disclosure is disposed to form a certain phase angle with respect to the front lifter 21.

Here, in 'phase angle', the angle of rotation of the drum 42 is defined by the time taken for the lifters 20 to reach a point on the circumference, and the circumferential distance ($D=\Delta\theta r$) corresponding to the phase angle indicated. In the embodiment, assuming that the drum 42 is rotated clockwise, the rear lifter 22 previously reaches the same height as much as the phase angle $\Delta\theta$ in comparison with the front lifter 11.

In the washing machine according to the embodiment of the present disclosure, the lifter 20 formed in the drum 42 includes the front lifter 21 and the rear lifter 22 that have the phase angle, thereby improving the strength of the drum.

In particular, plastic deformation may be reduced by improving the yield strength of the drum 42.

Plastic deformation refers to a state in which deformation caused by stress is not recovered.

Yield strength refers to the magnitude of the stress at which plastic deformation occurs. If the yield strength is large, plastic deformation is not easily occurred even by a large stress.

Figure 3:
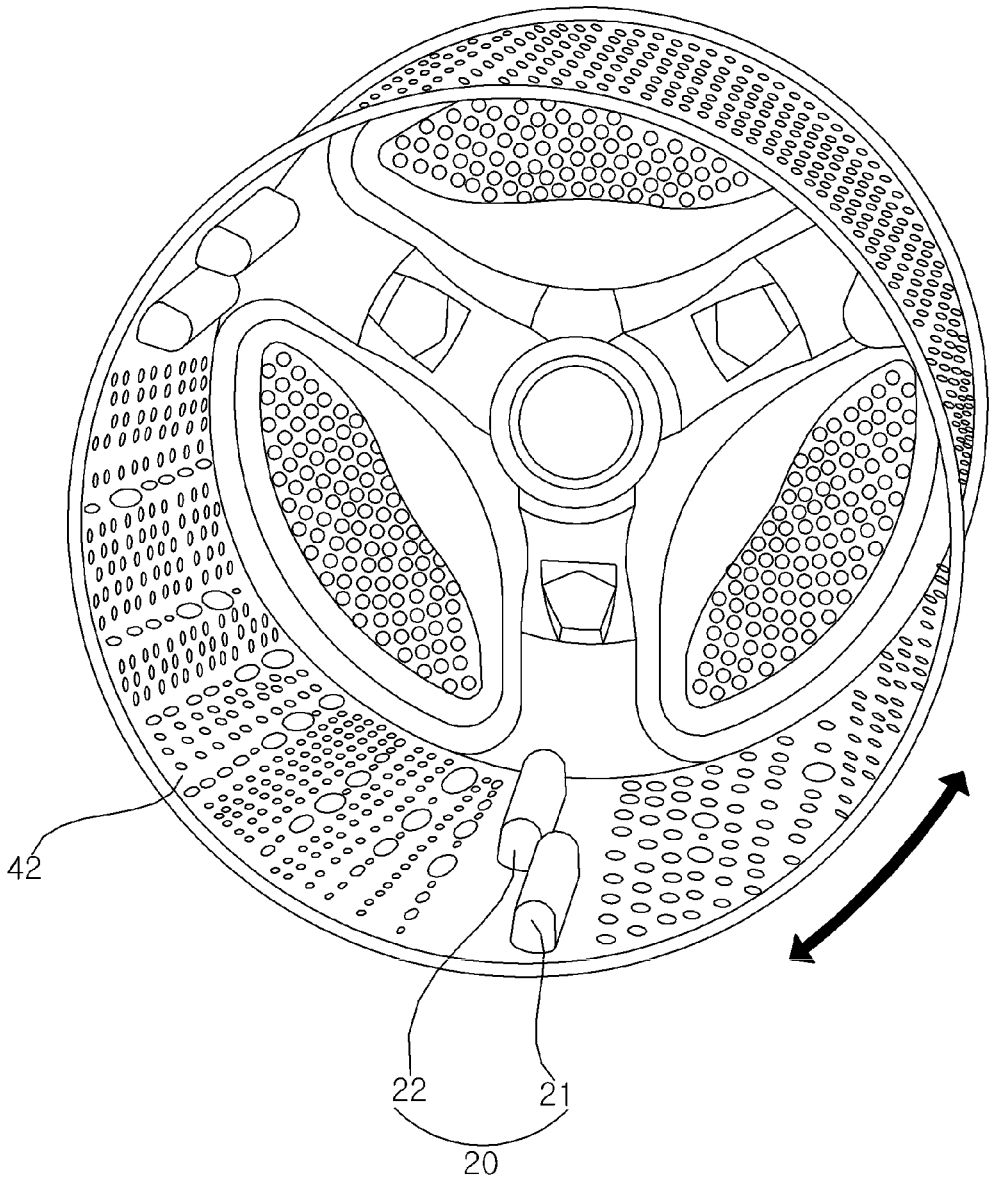
FIG. 3 shows a drum provided with lifters.
Figure 4:
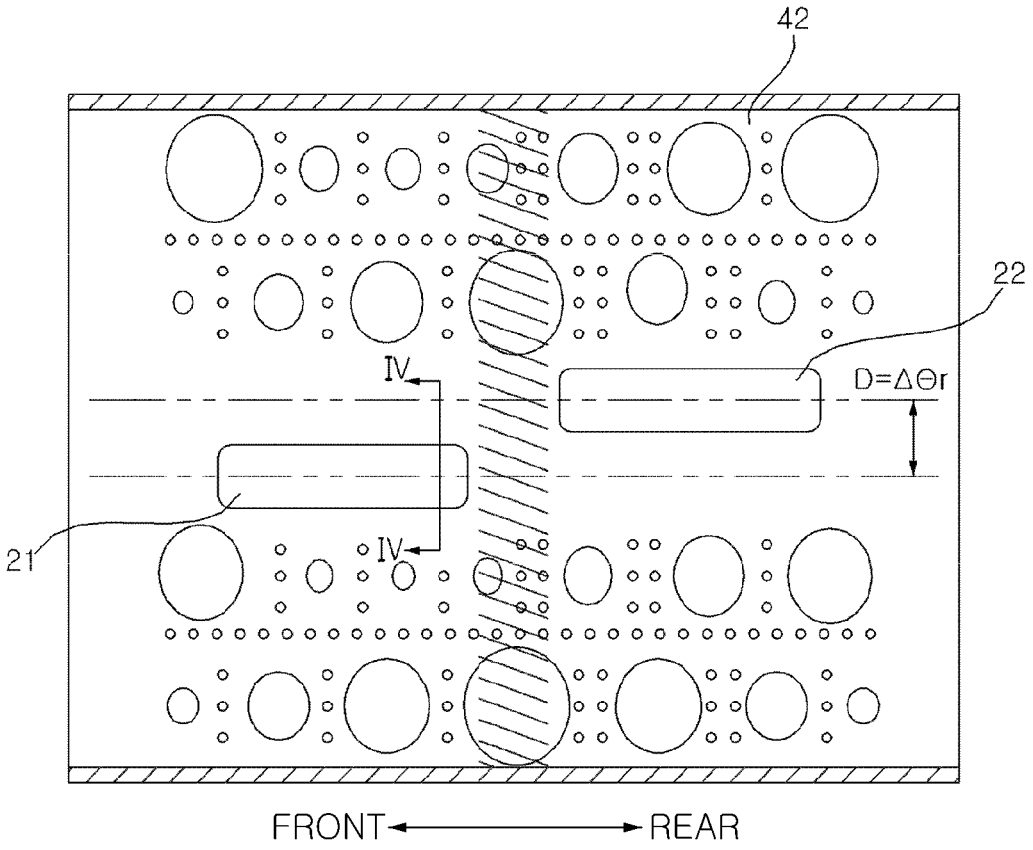
FIG. 4 schematically illustrates a longitudinal section of the washing tub shown in FIG. 1.
Figure 5:
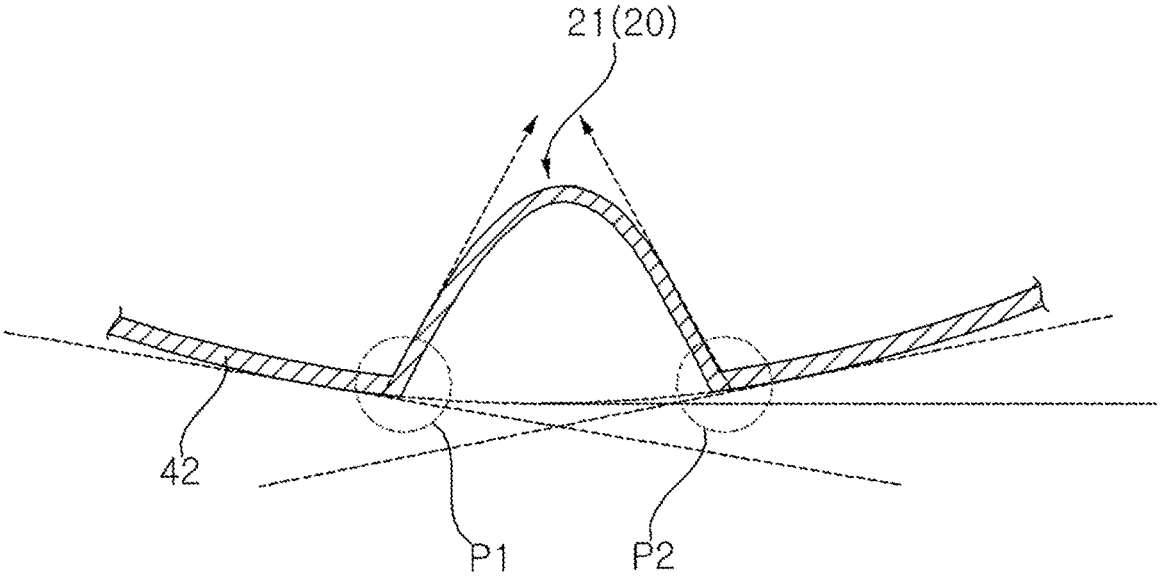
FIG. 5 is a cross-sectional view taken along line IV-IV of FIG. 4.

This will be described in detail with reference to FIGS. 3 to 5.

First, shear stress may be applied to the drum 42 rotating in a washing process.

Specifically, the motor 9 is coupled only at the rear portion of the drum 42, and the drum 42 may be formed by rolling round a thin stainless steel, e.g., a metal sheet having a thickness of 0.4 to 0.6 mm to join both ends to each other.

Therefore, when the drum 42 is accelerated or decelerated to rotate by the motor 9, a shear stress for twisting the drum 42 in the rotational direction may be applied to an intermediate portion CP of the drum 42.

In the present specification, the intermediate portion CP refers to an area having a certain width based on a virtual center line that bisects the drum 42. Further, a fact that the shear stress is applied to the intermediate portion CP does not mean that the shear stress is not applied to a portion excluding the intermediate portion CP, but particularly, the shear stress is mainly concentrated on the intermediate portion CP.

Specifically, the drum 42 is formed by processing a metal sheet having an integral structure. However, the thickness of the drum 42 is thin, and the rotational force due to the motor 9 is configured to be imparted to the rear of the drum 42 and transmitted to the front. Thus, shear stress may be applied to the intermediate portion CP, which is structurally located between the front and rear of the drum 42.

In addition, the lifter 20 formed by press working the metal sheet includes a portion P1, P2 where the curvature of surface is small and a sharp bend is formed, and when the press 20 is disposed to overlap the intermediate portion CP, the shear stress may be concentrated in the portion P1, P2 where the bend is formed.

Further, when the drum 42 is rotated while cloth that absorbed moisture and has a significant weight is loaded into the drum 42, a shear stress imparted to the intermediate portion CP may be added.

Specifically, since the lifter 20 serves to lift the cloth, a lifting force acts on the cloth, so that a reaction force against the lifting force acts so that the shear stress may be applied to the intermediate portion CP when the drum 42 rotates.

In such a drum 42 in which the lifter 20 is integrally formed by processing the metal sheet, when it exceeds the yield strength of the drum 42 due to the concentration of shear stress, the plastic deformation may occur so that the shape of the drum 42 is twisted or destroyed.

Accordingly, the drum 42 of the washing machine according to the embodiment of the present disclosure includes the front lifter 21 and the rear lifter 22 having the above described phase angle, thereby improving the yield strength of the drum 42 to prevent plastic deformation.

Figure 6:
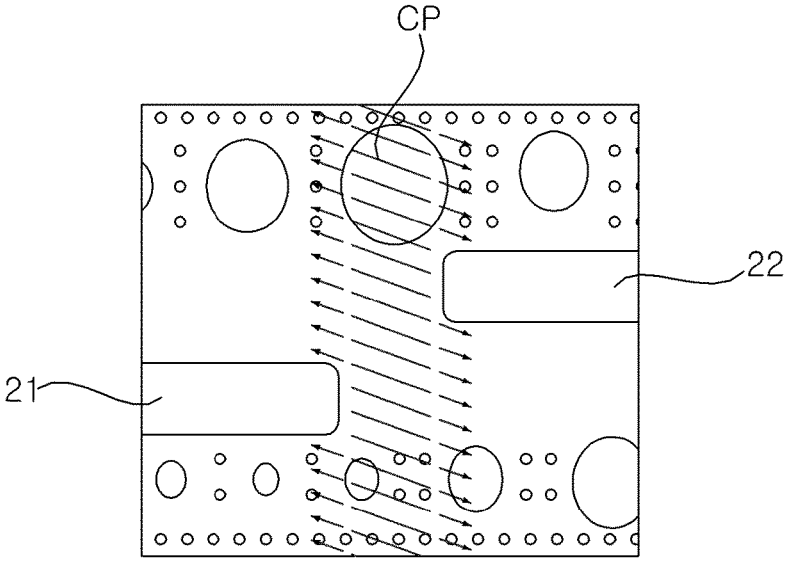
FIG. 6 is an enlarged view of a portion of FIG. 4.

Referring to FIG. 6, the drum 42 according to the embodiment of the present disclosure disperses the shear stress applied to the intermediate portion CP by the front lifter 21 and the rear lifter 22 having the phase angle to improve the yield strength.

Specifically, when viewed in the direction of the rotation axis, the rear lifter 22 is positioned ahead by the phase angle in the circumferential direction of the drum 20 so as not to overlap each other, and the rear end of the front lifter 21 may be disposed ahead of the front end of the rear lifter 22.

The intermediate portion CP may be formed at a distance between the rear end of the front lifter 21 and the front end of the rear lifter 22.

That is, the front lifter 21 and the rear lifter 22 may be disposed not to overlap with each other in the rotation axis direction and the circumferential direction and be displaced so as not to overlap with the intermediate portion CP.

Therefore, the intermediate portion CP between the rear end of the front lifter 21 and the front end of the rear lifter 22 can secure a shear stress dispersion region of sufficient width extended and integrally formed with the intermediate portion CP.

The shear stress applied to the intermediate portion CP may be dispersed into the shear stress dispersion region (arrow of FIG. 6) to prevent concentration of the shear stress on the intermediate portion CP.

Specifically, the shear stress applied to the intermediate portion CP may be dispersed into a portion extended and integrally formed with the intermediate portion CP.

However, the dispersion of the shear stress may be dispersed when the same surface curvature as the intermediate portion CP is formed, and if the portion extended and integrally formed with the intermediate portion CP forms a curved surface that is significantly different from the surface curvature of the intermediate portion CP, the dispersion of the shear stress may be disturbed and the shear stress may be concentrated in the intermediate portion CP.

Thus, in the drum 42 according to the embodiment of the present disclosure, even if shear stress is concentrated on the rear end of the front lifter 21, the front end of the rear lifter 22, and the front end of the intermediate portion CP, the shear stress dispersion region same as the surface curvature of the intermediate portion CP is secured, so that the shear stress can be effectively dispersed to improve the yield strength of the entire drum 42, thereby reducing the plastic deformation of the drum 42.

However, the dispersion direction of the shear stress is not limited to the direction indicated in the drawing.

In addition, the drum 42 according to the embodiment of the present disclosure may include the above mentioned front lifter 21 and the rear lifter 22 to increase the fatigue life N of the drum 42, and thus the durability of the drum 42 can be improved.

Specifically, the drum 42 is a structure that receives dynamic fluctuating stress, and even a stress smaller than the yield stress may cause fatigue failure which is destroyed by stress applied by long-time multiple rotations.

Therefore, the washing machine according to the embodiment of the present disclosure includes the above-described front lifter 21 and the rear lifter 22 to reduce the average shear stress applied to the intermediate portion CP, thereby increasing the fatigue life N of the drum 42.

Fatigue life is the total number of stress cycles required to cause fatigue failure at a specific stress.

Figure 7:
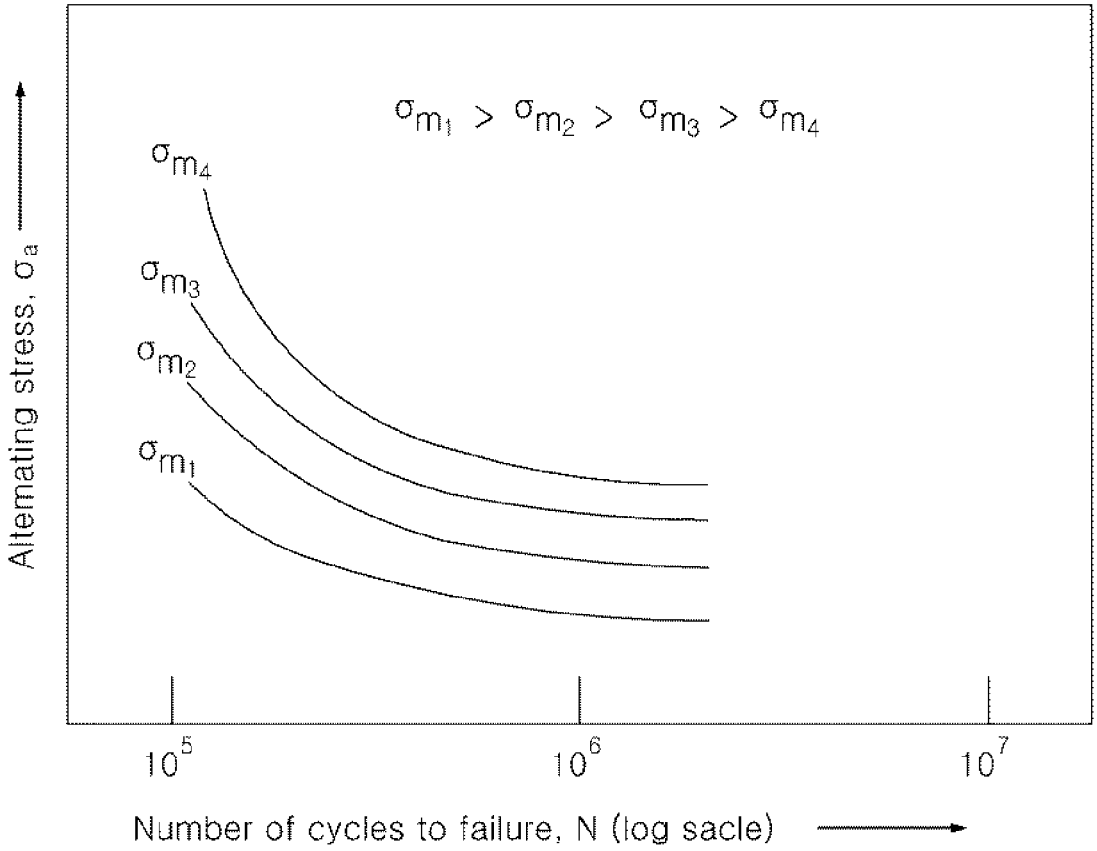
FIG. 7 is a graph showing fatigue life according to an applied stress.

Referring to FIG. 7, it can be seen that the as the average stress applied to the material becomes smaller, the fatigue life is increased and the durability is improved.

Taking this as a reference, in the drum 42 according to the embodiment of the present disclosure, shear stress is not concentrated in the intermediate portion CP by the displacement disposition structure of the front lifter 21 and the rear lifter 22, and is dispersed into an adjacent shear stress dispersion region.

Accordingly, the magnitude of the average stress acting on the intermediate portion CP is reduced, and thus, a long fatigue life can be obtained, and consequently, the durability of the drum 42 can be improved.

In addition, the drum 42 according to an embodiment of the present disclosure may include a reinforcement groove 25 extended in the circumferential direction in an area corresponding to a distance between the rear end of the front lifter 21 and the front end of the rear lifter 22. The reinforcement groove 25 may be located in the intermediate portion CP.

Figure 8:
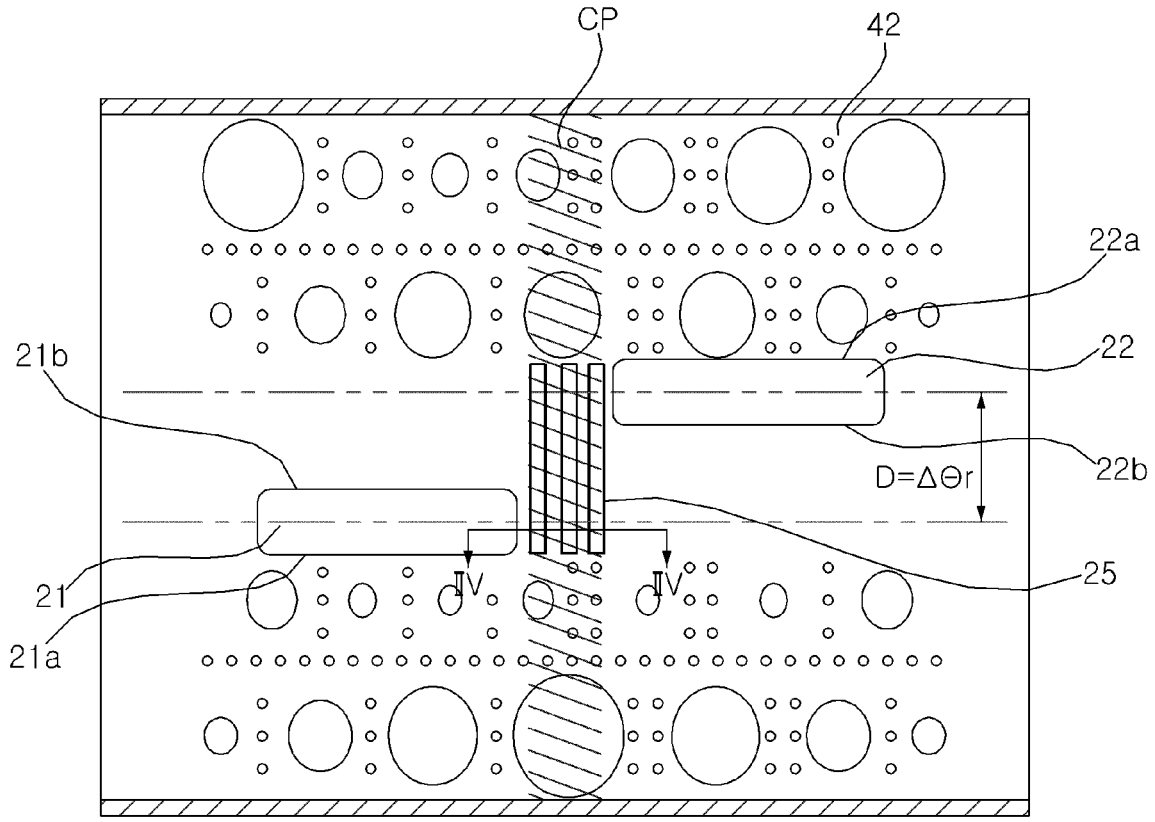
FIG. 8 illustrates a structure in which reinforcement groove is added to FIG. 5.
Figure 9:
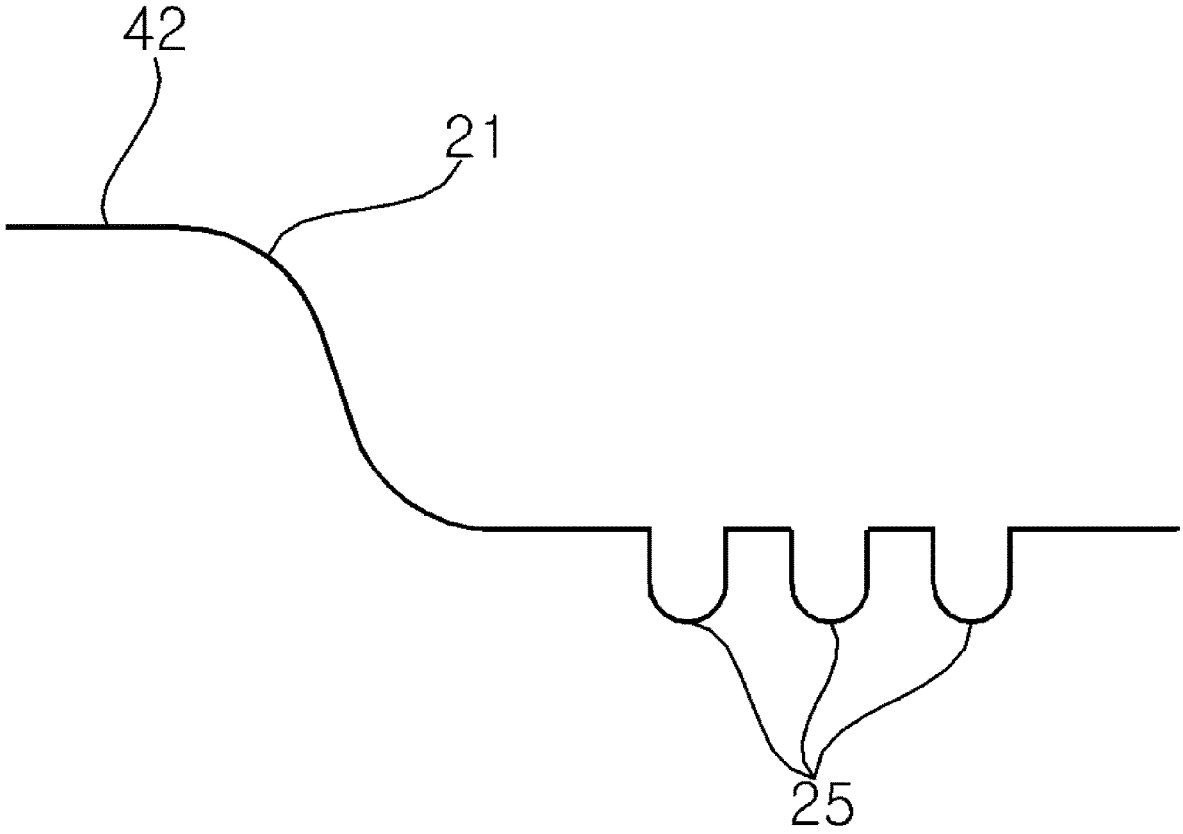
FIG. 9 is a cross-sectional view taken along line IIV-IIV of FIG. 8.

Referring to FIGS. 8 and 9, the reinforcement groove 25 may be formed on the inner circumferential surface of the drum 42.

Specifically, the reinforcement groove 25 is formed by bending or pressing the metal sheet forming the drum 42. Accordingly, a concave surface is formed on the inner circumferential surface of the drum 42 by the reinforcement groove 25, and a convex surface is formed in a point on the outer circumferential surface of the drum 42 corresponding to the concave surface.

The reinforcement groove 25 may be extended to connect a point corresponding to an outer edge 21*a* of the front lifter 21 and a point corresponding to an outer edge 22*a* of the rear lifter 22.

The present specification defines both side edges adjacent to between the front lifter 21 and the rear lifter 22 as an inner edge 21*b*, 22*b*, and defines the edge opposite to the inner edge as an outer edge 21*a*, 22*a*.

However, the present disclosure is not limited thereto, and the reinforcement groove 25 may be formed in the outer circumferential surface of the drum 42, and in this case, a concave surface is formed in the outer circumferential surface of the drum 42, and a convex surface is formed in the inner circumferential surface of the drum 42.

In addition, a plurality reinforcement grooves 25 (preferably, three or more) may be provided, and the depth may be equal to or more than 3 mm and less than 10 mm, the plurality of reinforcement grooves 25 may be spaced apart along the longitudinal direction of the drum 42, and a distance between adjacent reinforcements grooves 25 may be formed flat.

However, the number and depth of the reinforcement groove 25 are not limited to the contents disclosed in the above description and drawing, but will be included to the extent that the skilled person can easily change the design.

The drum 42 according to the embodiment of the present disclosure may increase the yield strength of the drum 42 by including the reinforcement groove 25.

In detail, the reinforcement groove 25 may serve as a dispersion path of the shear stress applied to the intermediate portion CP and disperse the stress. The shear stresses acting on the intermediate portion CP, in particular, on the portion adjacent to the rear end of the front lifter 21 and the front end of the rear lifter 22 on which the stress is concentrated may be dispersed along the reinforcement groove 25 and may be effectively dispersed to the surrounding shear stress dispersion region.

Therefore, the drum 42 including the reinforcement groove 25 can improve the yield strength, thereby further reducing plastic deformation.

In addition, the reinforcement groove 25 according to the embodiment of the present disclosure may improve the fatigue life of the drum 42.

Specifically, as described above, the reinforcement groove 25 may be formed by press working the metal sheet, and the compressive stress due to the press work is applied to the surface of the metal sheet so that the residual compressive stress exists on the surface of the metal sheet.

The residual compressive stress existing on the surface of the metal sheet suppresses generation of crack, thereby reducing the probability of breakage, and consequently, improving the fatigue life of the drum 42 and finally improving durability.

Figure 10:
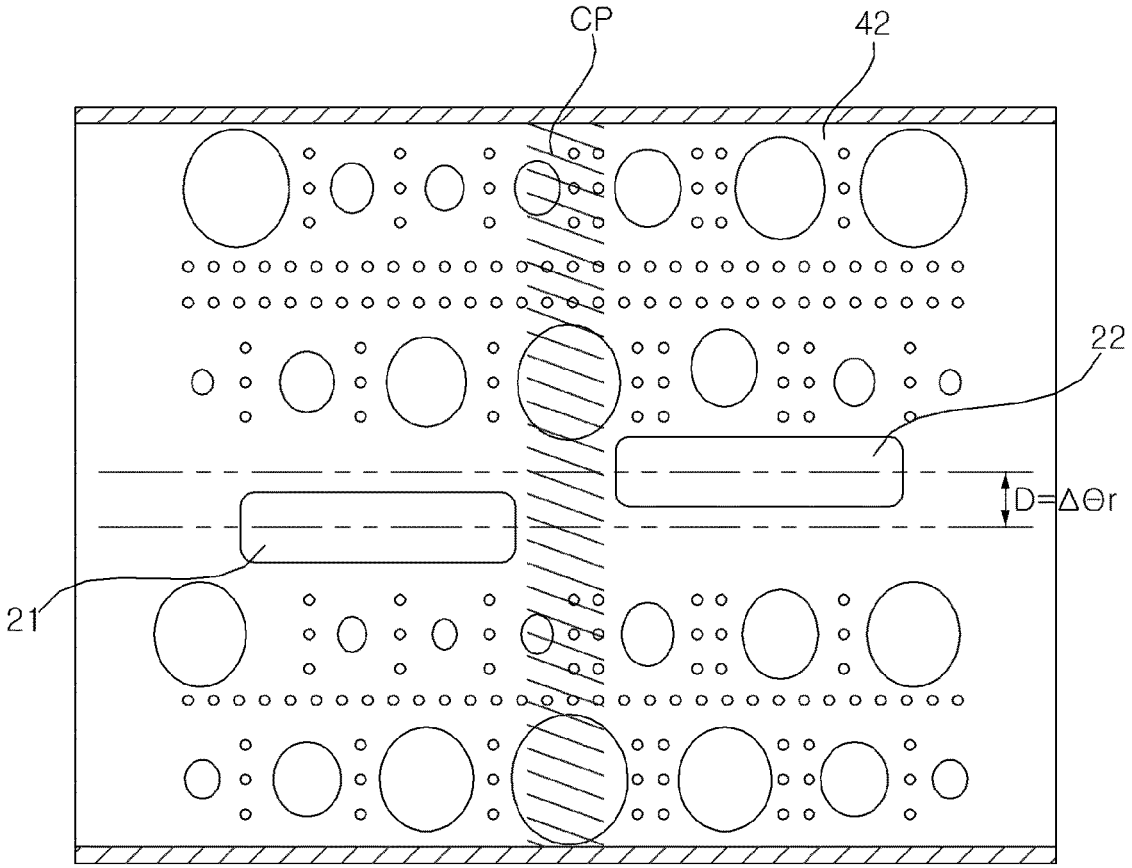
FIG. 10 schematically illustrates a longitudinal section of a drum according to another embodiment of the present disclosure.
Figure 11:
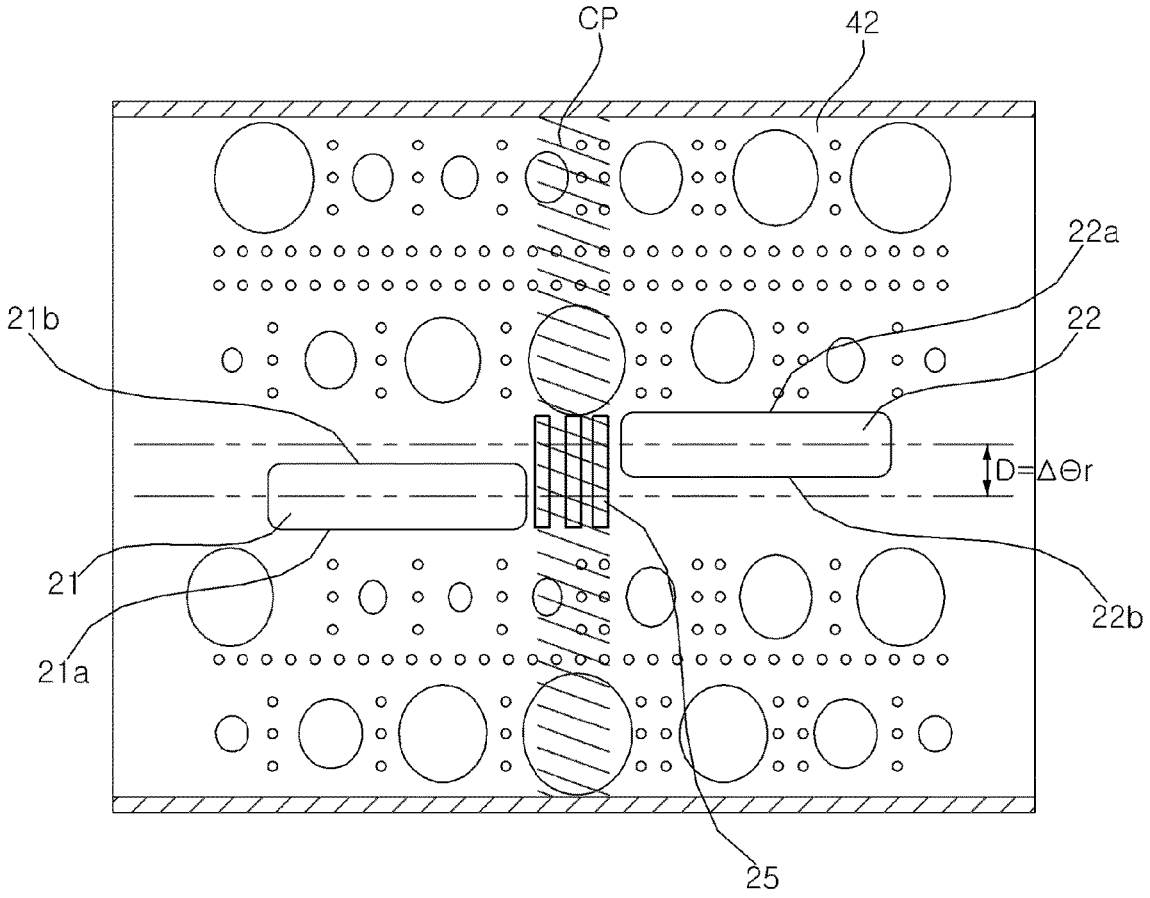
FIG. 11 illustrates a structure in which reinforcement groove is added to FIG. 10.

Next, a drum 42 according to another embodiment of the present disclosure will be described with reference to FIGS. 10 and 11.

The drum 42 according to the present embodiment is substantially the same as the drum 42 described with reference to FIGS. 1 to 9 except a difference in the arrangement of the front lifter 21 and the rear lifter 22 and the arrangement of the reinforcement groove 25.

Accordingly, like reference numerals refer to like elements, and thus repeated descriptions will be omitted. Therefore, in the description according to the present embodiment, the differences will be mainly described.

In the drum 42 according to another embodiment of the present disclosure, when viewed in the rotational axis direction, the front lifter 21 and the rear lifter overlap each other, and the rear end of the front lifter 21 may be disposed ahead of the front end of the rear lifter 22.

Phase angle of the front lifter 21 and the rear lifter 22 according to another embodiment of the present disclosure may be smaller than the phase angle according to the above-described embodiment.

In the drum 42 according to another embodiment of the present disclosure, when viewed in the direction of the rotation axis among the intermediate portion CP to which the shear stress is applied, there may exist a portion overlapping with both the front lifter 21 and the rear lifter 22.

In addition, the drum 42 according to another embodiment of the present disclosure may have a reinforcement groove 25, which is extended in the circumferential direction, formed in an area corresponding to a distance between the rear end of the front lifter 21 and the front end of the rear lifter 22.

In addition, the reinforcement groove 25 may be extended to connect a point corresponding to the outer edge 21*a* of the front lifter 21 and a point corresponding to the outer edge 22*a* of the rear lifter 22.

The reinforcement groove 25 allows the drum 25 according to another embodiment of the present disclosure to further improve yield strength and fatigue life, and consequently, to enhance durability.

Figure 12:
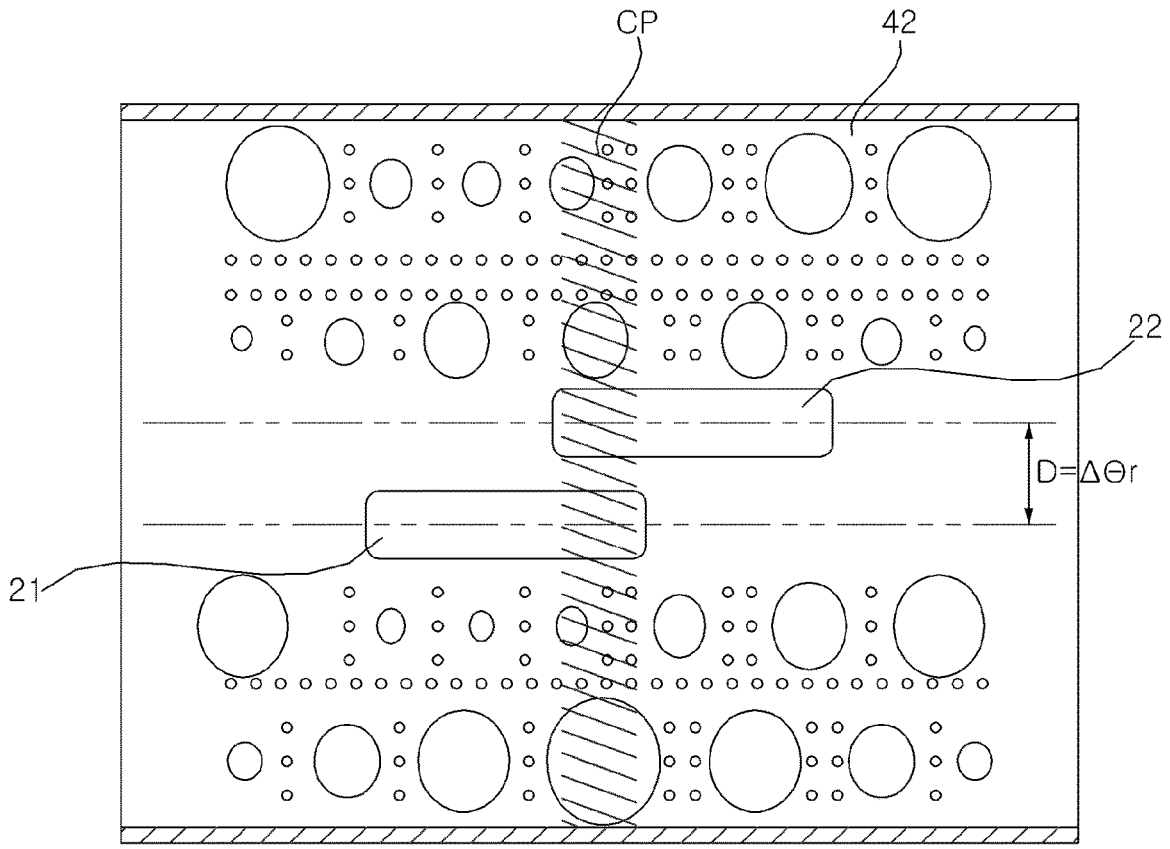
FIG. 12 schematically illustrates a longitudinal section of a drum according to another embodiment of the present disclosure.
Figure 13:
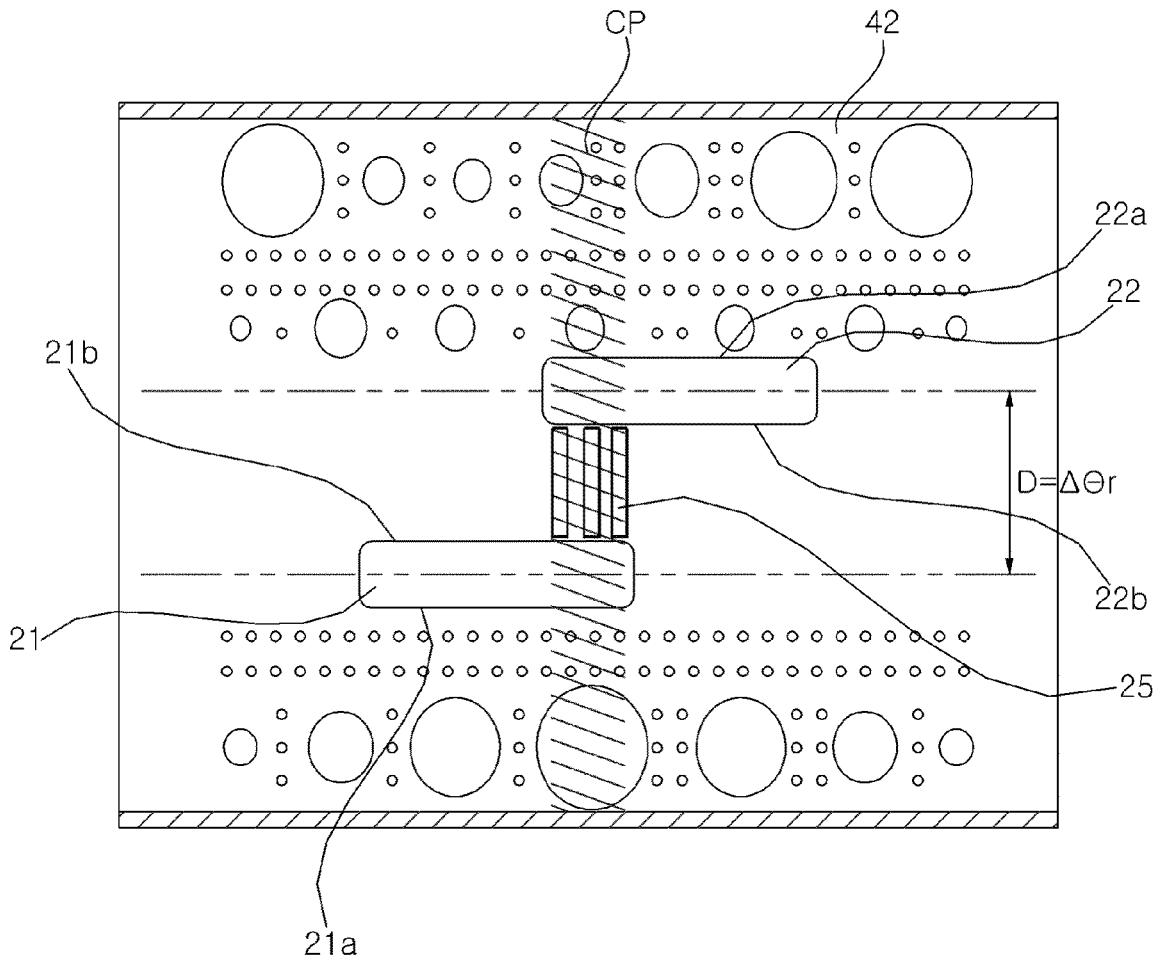
FIG. 13 illustrates a structure in which reinforcement groove is added to FIG. 12.

Next, a drum 42 according to another embodiment of the present disclosure will be described with reference to FIGS. 12 and 13.

The drum 42 according to another embodiment is substantially the same as the drum 42 described with reference to FIGS. 1 to 9 except a difference in the arrangement of the front lifter 21 and the rear lifter 22 and the arrangement of the reinforcement groove 25.

Accordingly, like reference numerals refer to like elements, and thus repeated descriptions will be omitted. Therefore, in the description according to the present embodiment, the differences will be mainly described.

In the drum 42 according to another embodiment of the present disclosure, the front lifter 21 and the rear lifter 22 may overlap each other when viewed in the circumferential direction.

Therefore, the front end of the rear lifter 22 may be disposed relatively forward than the rear end of the front lifter 21, and the intermediate portion CP may overlap with the front lifter 21 and the rear lifter 22.

In addition, the drum 42 according to another embodiment of the present disclosure may have a reinforcement groove 25, which is extended in the circumferential direction, formed in an area corresponding to a distance between the rear end of the front lifter 21 and the front end of the rear lifter 22.

In addition, the reinforcement groove 25 may be extended in the circumferential direction to the area corresponding to between the rear end of the front lifter 21 and the front end of the rear lifter 22 and between the inner edge 21*b* of the front lifter 21 and the inner edge 22*b* of the rear lifter 22.

The reinforcement groove 25 allows the drum 25 according to another embodiment of the present disclosure to further improve yield strength and fatigue life, and consequently, to enhance durability.

As described above, first, in the washing machine of the present disclosure, the lifter is formed integrally with the drum, the lifter includes two protrusions spaced apart from each other in the longitudinal direction of the drum, thereby improving the yield strength of the drum to reduce the plastic change in comparison with a conventional drum having a lifter formed of a single protrusion extended long.

Yield strength refers to the magnitude of the stress by which plastic deformation occurs. If the yield strength is large, plastic deformation does not easily occur even at a large stress.

Second, the fatigue life of the drum can be increased by reducing the average shear stress applied to the drum during the drum rotation by the motor, thereby improving the durability of the drum.

Third, yield strength and fatigue life of the drum can be increased by forming a reinforcement groove between lifters, thereby improving the durability.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a casing;

a washing tub rotatably disposed in the casing, the washing tub comprising:

a drum having an elongated cylindrical shape, the drum having an opening defined at a front side of the drum and configured to receive laundry, and a rear cover coupled to a rear end of the drum;

a motor configured to rotate the washing tub; and a plurality of lifters where each lifter protrudes from an inner circumferential surface of the drum and is configured to lift the laundry from the inner circumferential surface of the drum based on rotation of the drum, the plurality of lifters extending along a longitudinal direction of the drum and being spaced apart from each other in a circumferential direction of the drum, wherein the plurality of lifters include:

a front lifter that is disposed closer to the opening than to the rear cover, and a rear lifter that is disposed closer to the rear cover than to the opening, the rear lifter being disposed rearward of the front lifter, wherein a longitudinal center line of the front lifter and a longitudinal center line of the rear lifter are spaced apart from each other in the circumferential direction of the drum, and wherein at least a portion of the front lifter overlaps with at least a portion of the rear lifter along the longitudinal direction of the drum such that the front lifter and the rear lifter at least partially overlap each other when viewed from the front side of the drum in a direction of a rotation axis of the drum.

2. The washing machine of claim 1, wherein the front lifter and the rear lifter are formed integrally with the drum.

3. The washing machine of claim 2, wherein the drum has a reinforcement groove which is disposed between the front lifter and the rear lifter.

4. The washing machine of claim 3, wherein the reinforcement groove extends in the circumferential direction of the drum.

5. The washing machine of claim 4, wherein a plurality of reinforcement grooves is arranged in the longitudinal direction of the drum.

6. The washing machine of claim 1, wherein each of the front lifter and the rear lifter has (i) a front end facing the opening and (ii) a rear end facing the rear cover, and wherein the rear end of the front lifter is disposed forward of the front end of the rear lifter and is spaced apart from the front end of the rear lifter in the longitudinal direction of the drum.

7. The washing machine of claim 6, wherein the drum has a reinforcement groove defined between the rear end of the front lifter and the front end of the rear lifter.

8. The washing machine of claim 7, wherein the reinforcement groove extends in the circumferential direction of the drum.

9. The washing machine of claim 8, wherein the reinforcement groove is one of a plurality of reinforcement grooves that are arranged in the longitudinal direction of the drum.

10. The washing machine of claim 1, wherein the front lifter and the rear lifter have a height within a range of 10 mm to 30 mm.

11. The washing machine of claim 1, wherein the drum has a thickness within a range of 0.4 mm to 0.6 mm.

12. The washing machine of claim 1, wherein the front lifter has an inner edge and an outer edge that are spaced apart from each other in the circumferential direction and that are disposed at opposite sides of the longitudinal center line of the front lifter, wherein the rear lifter has an inner edge and an outer edge that are spaced apart from each other in the circumferential direction and that are disposed at opposite sides of the longitudinal center line of the rear lifter, and wherein a circumferential distance from the longitudinal center line of the front lifter to the inner edge of the front lifter is greater than a circumferential distance from the longitudinal center line of the front lifter to the inner edge of the rear lifter.

13. The washing machine of claim 12, wherein the drum has a reinforcement groove that extends in the circumferential direction between a first position corresponding to the outer edge of the front lifter and a second position corresponding to the outer edge of the rear lifter.

14. The washing machine of claim 12, wherein the drum has a plurality of reinforcement grooves that extend in the circumferential direction between a first position corresponding to the outer edge of the front lifter and a second position corresponding to the outer edge of the rear lifter.

* * * * *